United States Patent [19]

Meyer

[11] 4,249,648

[45] Feb. 10, 1981

[54] TOKEN IDENTIFYING SYSTEM

[75] Inventor: John A. Meyer, Buffalo Grove, Ill.

[73] Assignee: Keene Corporation, New York, N.Y.

[21] Appl. No.: 900,497

[22] Filed: Apr. 27, 1978

[51] Int. Cl.[3] ..... G07D 5/02

[52] U.S. Cl. ..... 194/102; 194/1 R; 235/92 CN

[58] Field of Search ..... 194/97 R, 99, 102, 1 R; 73/163; 133/3 R; 235/92 CN

[56] References Cited

U.S. PATENT DOCUMENTS

| | | | |
|---|---|---|---|
| 2,943,631 | 7/1960 | Warrick et al. | 133/3 R |
| 3,830,401 | 8/1974 | Benwood et al. | 222/57 |
| 3,939,954 | 2/1976 | Collins | 194/102 |
| 4,082,099 | 4/1978 | Iwersen | 194/102 X |

OTHER PUBLICATIONS

Murphy et al., "Fast Sorting with CCD", Fairchild Journal of Semiconductor Progress, 9–77.

"Non-contact Measuring System Uses Photodiode Array Line Scan Camera", Computer Design, 6–73.

*Primary Examiner*—Joseph J. Rolla

*Attorney, Agent, or Firm*—Albert L. Jeffers; Roger M. Rickert

[57] ABSTRACT

A token receiving and categorizing system and method which identifies tokens as a particular one of several acceptable tokens or as an unacceptable token includes the performance of a series of measurements of chord lengths on a token and selecting the largest of those chord length measurements for comparison with each of a plurality of stored disjoint token diameter ranges. An indication of a particular acceptable token denomination is recorded only if the largest chord length measurement is within a stored token diameter range corresponding to that denomination. The chord length measurements are performed by causing the token to fall between a light source and a linear light sensing array with the source casting a shadow of the token onto the array. The first location within the array at which a transition from light to shadow occurs, as well as the last location within the array at which a transition from shadow to light occurs, are identified with the difference between those two locations forming an indication of chord lengths. A chord length measurement may be repeated, for example from 40 to 80 times during the passage of a token. The monetary amount of each token deposited, if applicable, may be displayed as well as an accumulated total for a sequence of tokens on either a short term or long term basis. Various electromechanical devices may be coupled to the system in a manner to prevent transient current generation from those devices interfering with the system operation.

19 Claims, 10 Drawing Figures

TOKEN IDENTIFYING SYSTEM

BACKGROUND OF THE INVENTION

The present invention relates generally to the receiving of tokens and more particularly to the receiving and categorizing of those tokens as particular acceptable types or as being unacceptable according to their optically sensed size. The system has particular utility in public transportation systems, for example at a passenger entrance location where that passenger is required to deposit a fee in the form of one or more coins or a transit authority token.

The conventional fare box frequently encountered in mass transit systems includes a coin chute into which a passenger places a transit authority token or other tokens such as coins of varying monetary value with these tokens coming to rest on a flat plate where they may be inspected by a transit authority employee, such as the driver of a bus, streetcar or the like. Once the operator has confirmed that the appropriate fare has been deposited, he actuates a lever to dump the tokens from the inspection plate into an accumulating vault in the fare box pedestal preparatory to receiving further fares from the passengers.

Fare boxes of the foregoing type have long been in use and numerous modifications and improvements thereon have from time to time appeared. One such improvement is illustrated in U.S. Pat. No. 3,939,954 wherein deposited tokens are arranged serially or in single file to pass an optical sensing arrangement for determining the token diameter. One token edge is urged into engagement with a reference surface while the opposite token edge obscures certain light sensors while allowing light to pass from certain light sources to other of the light sensors with the particular sensors obscured or unobscured providing a measure of the position of the one coin edge relative to the reference surface. The accuracy of such an arrangement is highly dependent upon the coin or token being in engagement with the reference surface. The optical sensing arrangement which is typically an array of light emitting diodes and corresponding photo transistors provides only an indication of the lateral extent of one token edge which indication is presumed to be relative to the reference surface, with the other token edge engaging that surface.

Another variation on the classic fare box is illustrated in U.S. Pat. No. 3,918,565, wherein a property of the token material, such as a frequency shift due to a magnetic property thereof, is measured as the token is deposited. This measurement provides a single token parameter or a sequence of single token parameters indicative of a token material characteristic, such as its permeability or reluctance. After an analog to digital conversion, the token test result or results are compared to preset results and a decision on the validity and type of token is made. This system has no provision for size discrimination between tokens but rather relies on the token material characteristics. The system is further rather costly and requires frequent and careful maintenance, relying as it does on frequency or phase shift measurements and suffering from all of the problems associated with such measurements.

SUMMARY OF THE INVENTION

Among the several objects of the present invention may be noted the provision of a system for receiving tokens employing a factory set read-only memory for storing acceptable token information; the provision of a token receiving and categorizing system which operates independent of small variations in the token velocity or in the path traversed by the token during the identification process; the provision of such a token receiving and categorizing system wherein the passage of a token into the system initiates operation of at least a part of the system; the provision of a token receiving and categorizing system which is adaptable to varying sets of acceptable tokens yet utilizes many relatively inexpensive commercially available components; the provision of a system for categorizing tokens characterized by its improved reliability and economy of manufacture and maintenance; and the provision of a token categorizing system having operator actuable inputs and electromechanical outputs with at least some of the input and output arrangements optically isolated from digital processing portions of the system. These as well as other objects and advantageous features of the present invention will be in part apparent and in part pointed out hereinafter.

In general, a token is categorized as a particular one of several acceptable tokens or as an unacceptable token, by performing a series of chord length measurements on that token and selecting the largest such chord length measurement for comparison with each of a plurality of stored disjoint token diameter ranges and recording an indication of a particular acceptable token denomination only if the largest chord length measurement is within a stored range corresponding to that denomination.

Also in general and in one form of the invention, a system for receiving tokens includes a token chute having a light source disposed to one side thereof and an array of light sensing elements disposed to the other side thereof, with a relatively transparent region in the token chute intermediate the light source and the array. The array of light sensing elements is repetitively interrogated a plurality of times during the passage of a token through the transparent region and transitions from light to dark and dark to light within that array during each interrogation thereof are identified and an indication of token chord lengths is thus provided. Successive token chord length indications are stored and processed to select the largest chord length indication and that largest indication compared to a plurality of different acceptable token indications with the particular token under inspection being identified as a certain acceptable type, if the indication of the largest chord length matches the corresponding particular acceptable stored token indication.

The system for receiving tokens may be embodied as a token chute having an opening near the top thereof for receiving tokens followed by an arrangement for serializing those tokens to pass further down the chute under the action of gravity and past a light source disposed to one side of the chute with an array of light sensing elements disposed to the side of the token chute opposite that light source with a relatively transparent region in the token chute intermediate the light source and the array. The arrangement may embody an actuating sensor near the token chute entrance for energizing the token serializing mechanism and may further include a feedback arrangement to maintain the light source at a preferred operating intensity. In one preferred form, the light sensing array is interrogated by transferring indications from each light sensing cell within the array in parallel to a shift register arrangement and subsequently shifting each cell indication from that shift register to a comparitor while at the same time an indication of the particular cell indication being transferred is temporarily stored in a register. Significant changes in cell indications are then a signal to record the cell identification as being a light to dark or dark to light transition thereby allowing, for each complete shift register cycle, a first light to dark transition indication followed by a last of (perhaps several) dark to light transitions with the difference of these two comprising an indication of the token chord length.

BRIEF DESCRIPTION OF THE DRAWING

Corresponding reference characters indicate corresponding parts throughout the several views of the drawing.

Figure 1:
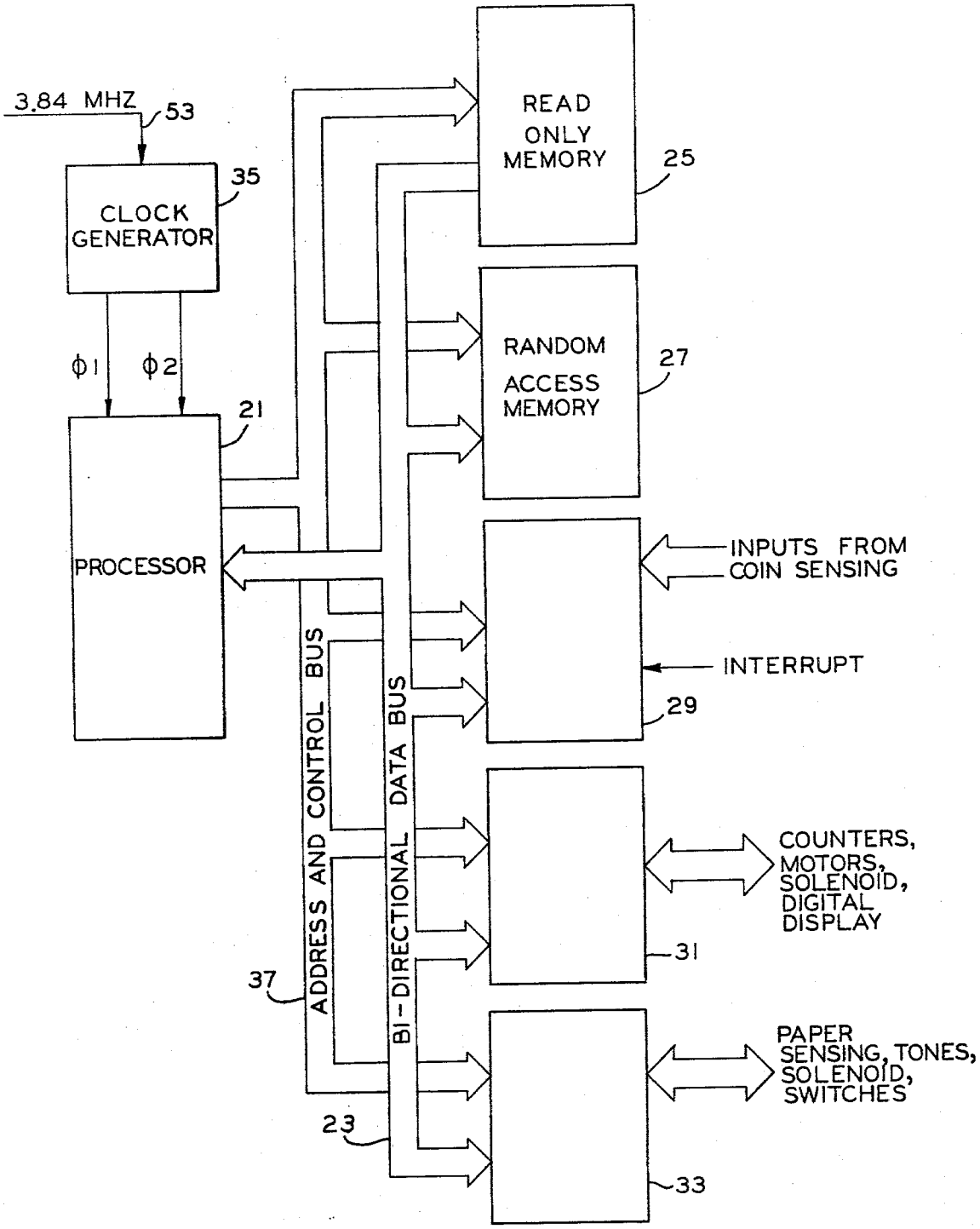
FIG. 1 is a block diagram of the processor which may be employed in implementing the present invention.

The exemplifications set out herein illustrate a preferred embodiment of the invention in one form thereof and such exemplifications are not to be construed as limiting the scope of the disclosure or the scope of the invention in any manner.

DESCRIPTION OF THE PREFERRED EMBODIMENT

Referring now to the drawings in general, a method is provided in one form of the invention for receiving and categorizing tokens as particular ones of several acceptable tokens or as an unacceptable token and includes the performance of a series of measurements of chord lengths on that token with the largest of such chord length measurements being selected as representing the particular token and to be compared with stored token diameter measurement ranges so that an indication of that token being of a particular acceptable denomination may be made if the largest chord length measurement is within a particular stored token diameter range corresponding to that denomination. Successive chord length measurements may be compared and a token categorized as unacceptable if two successive chord length measurements differ by more than some predetermined amount.

Figure 6:
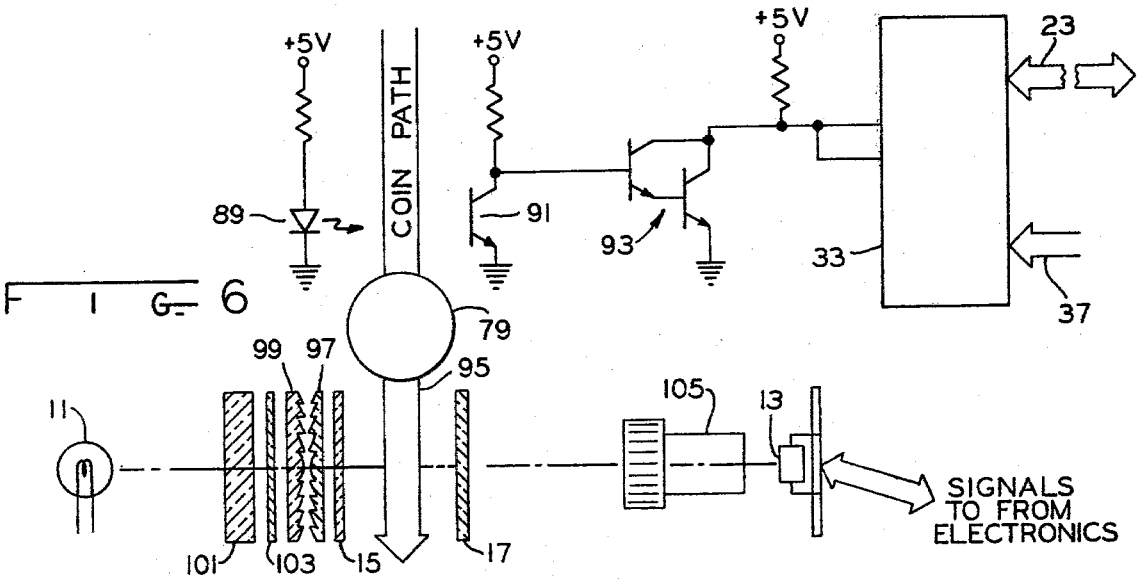
FIG. 6 illustrates in a schematic form the token sensing and measuring circuits and related optical system.
Figure 7:
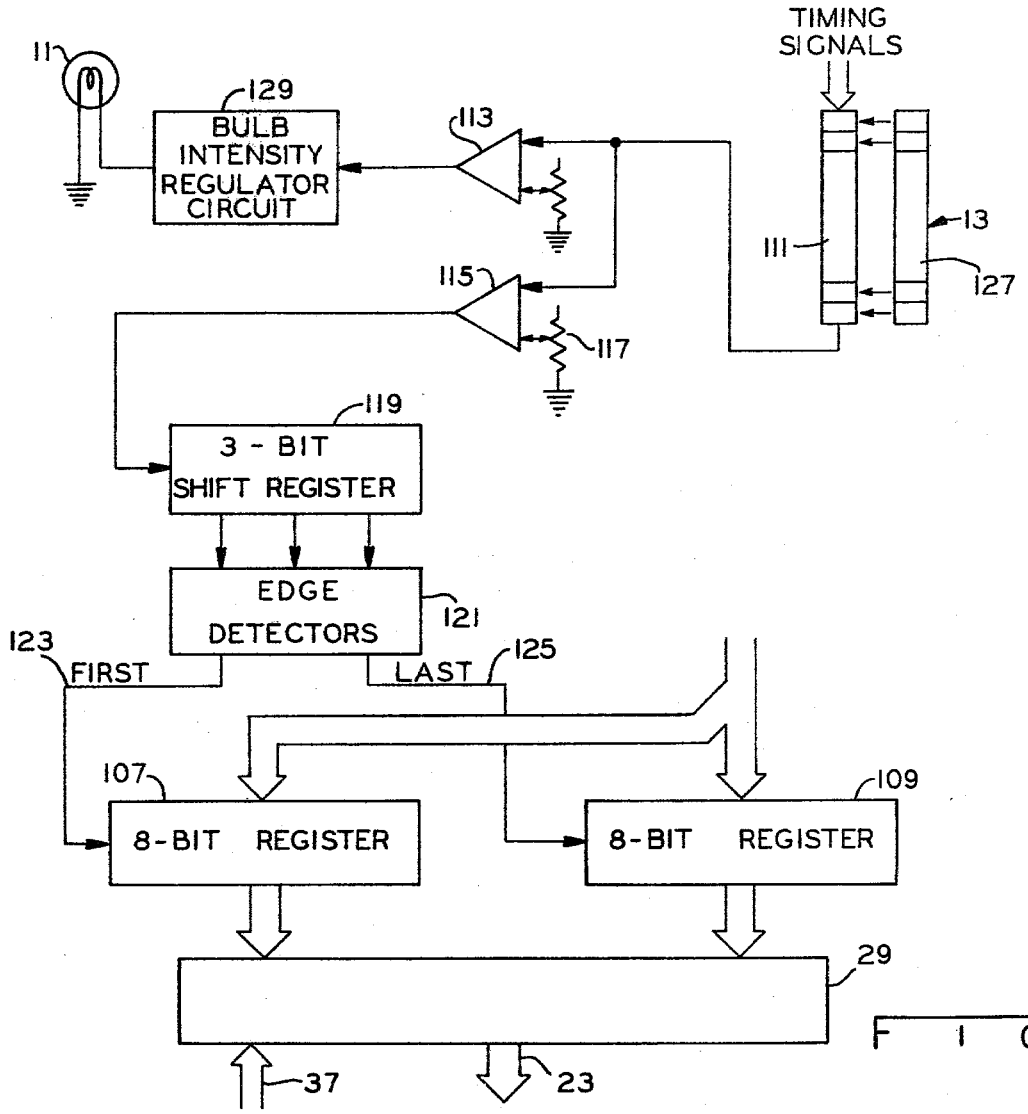
FIG. 7 is a schematic diagram of the token measuring circuitry.

The series of measurements may be performed as illustrated in FIG. 6 by causing the token to fall between a light source 11 and a linear light sensing array 13 with the light source casting a shadow of the token onto the array. Each such measurement may, as depicted in FIG. 7, include an identification of the first location within the light sensing array 13 at which a transition from light to shadow occurs along with an identification of the last location within the array at which a transition from shadow to light occurs. A visible indication of a particular acceptable token may be temporarily displayed after receipt thereof and the system may be arranged so that an operator may visually inspect the token after it has been measured and the denomination thereof displayed as a cross-check to insure that the displayed denomination is correct. This might be accomplished by a relatively conventional dump plate disposed beneath the coin path of FIG. 6. As illustrated generally in FIG. 4, an accumulation of the total number of certain token denominations as well as an accumulation of the total monetary value corresponding to certain other received token denominations may be maintained on a suitable number of electromechanical counters.

As illustrated generally in FIG. 7, the intensity of the light source 11 may be periodically sensed with that sensed intensity compared to a reference so that the light source may be dimmed if the sensed intensity exceeds the reference, or the intensity of the light source may be increased if such action is indicated by the comparison. This automatic compensation will avoid erroneous indications which might be otherwise encountered due to light source voltage variations, filament evaporation, or the simple accumulation of dirt, for example on the relatively transparent surfaces 15 and 17 within the coin chute.

Figure 5:
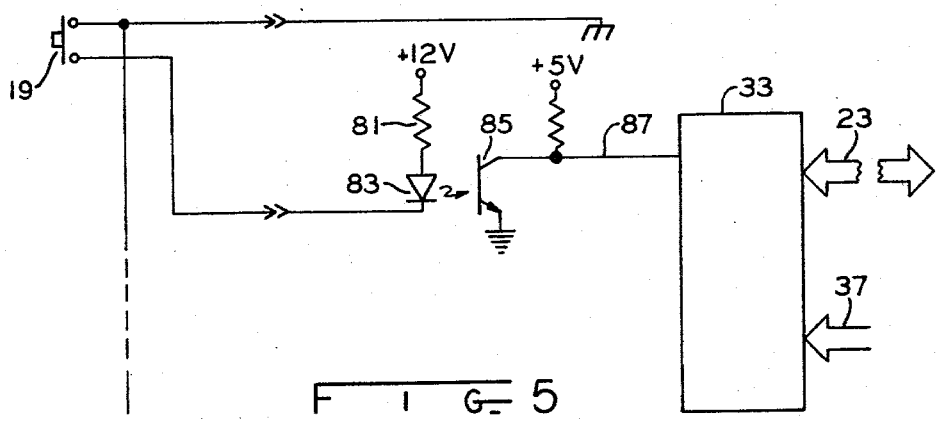
FIG. 5 is a schematic diagram, partially in block form, illustrating the manner of providing operator input signals to the processor of FIG. 1.

Numerous operator actuable input switches, such as 19 of FIG. 5, may also be employed to allow the operator to, for example, insert information identifying a particular category of passenger or to dump tokens accumulated on the inspection plate as well as for other purposes to be discussed later in greater detail. The switch, as illustrated in FIG. 5, may be periodically interrogated in a manner so as to recognize a change in that switch state only if three successive interrogations show the switch to first be in one state and thereafter on both the second and third interrogations to be in another state. Such successive interrogations function to filter out momentary switch closure or contact bounce. Optical isolation between the input switches and the processor may also be provided. Such an input switch may define a monetary amount so that the processor will accumulate a total of the monetary value corresponding to certain received token denominations and provide an output indication when the accumulated total becomes at least as large as the defined amount.

The chord length comparisons may be predicated on a stored token diameter range including a first stored value indicating a minimum acceptable chord length and a second stored value indicating a maximum acceptable chord length or each stored token diameter range may include a nominal chord length measurement along with acceptable tolerance ranges therefor.

Turning now particularly to the processor block diagram of FIG. 1, that processor is seen to include seven major components each of which may correspond to a commercially available integrated circuit chip. The components of FIG. 1 are, for example, available from Motorola, Inc. and are discussed in detail in the publication by that supplier entitled "M6800 Microcomputer System Design Data" published in 1976. Briefly, the microprocessor 21 is an integrated circuit which contains the logic and arithmetic circuitry for controlling the token receiving system and this microprocessor is connected by a bidirectional data bus 23 to a read only memory 25 which is a non-volatile storage device which contains the program and data for determining the actions of the microprocessor 21. The bidirectional data bus 23 also interconnects the microprocessor and a random access memory unit 27 which is read-write memory used by the microprocessor for temporary storage of the data. Three peripheral interface adapters 29, 31 and 33 are also coupled by way of the bidirectional data bus 23 to the microprocessor unit and function as programmable interface circuits to provide access between the microprocessor and the several input and output arrangements to be discussed subsequently. The microprocessor also receives two basic timing signals from a clock generator 35 described in greater detail in FIG. 3.

FIG. 1 further illustrates an address bus 37 which provides addressing information from the microprocessor 21 to the memories 25 and 27 as well as the peripheral interface adapters 29, 31 and 33 by way of non-inverting 8T97 buffers which are not illustrated but are described in detail in the aforementioned Motorola Systems Design publication. The address and control bus 37 provides three bits to an address decoder of conventional type such as a 74LS138 which converts those three bits to the one-out-of-eight code for determining the particular device being accessed. The address and control bus 37 further provides twelve bits for selecting the particular memory element or register being accessed within the device selected by the decoder. Two additional control lines on the address and control bus provide a valid memory address signal indicating the address bus lines have a valid address on them and that memory access is taking place but otherwise ignoring the address bus; and a read or write indication defining the direction of data flow on the data bus 23.

Figure 2:
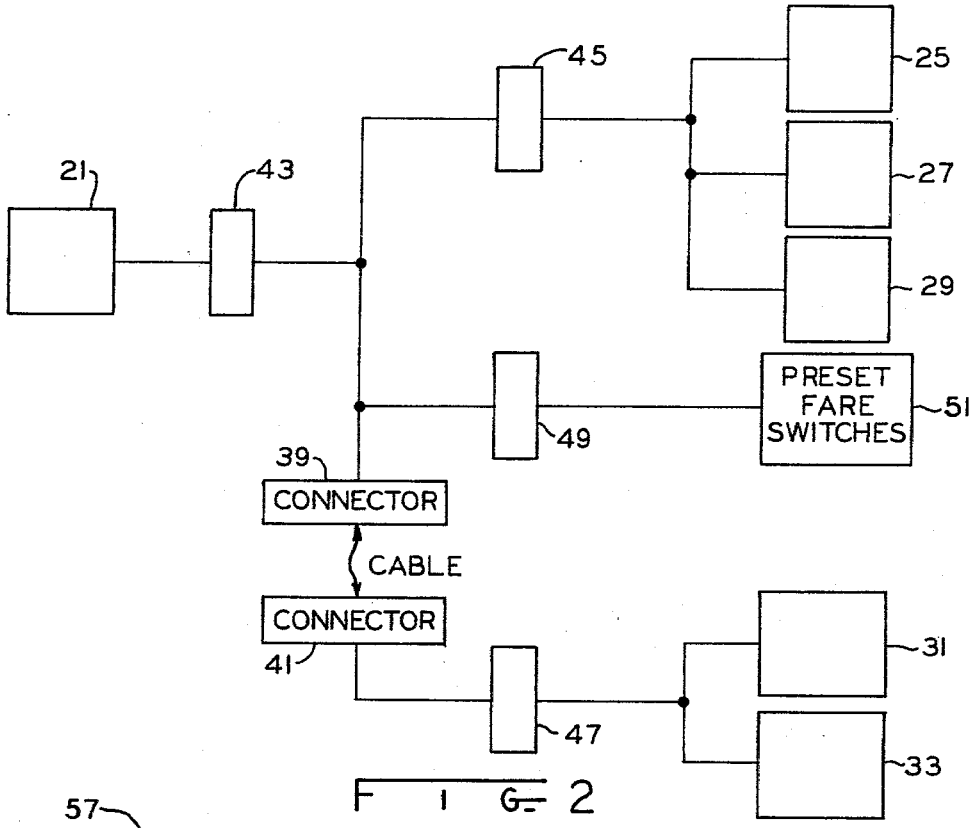
FIG. 2 is a block diagram of portions of the processor of FIG. 1 illustrating the data bus configuration in greater detail.

The data bus is illustrated in somewhat greater detail in FIG. 2 and it will be noted that both the data bus and the address bus may be tapped for external access by way of the cable connectors 39 and 41. The data bus is of course bidirectional and includes several buffers 43, 45 and 47 for example of the type 8T26 described in greater detail in the aforementioned Motorola System Design data book. A still further 8T97 buffer 49 may also be employed.

Data transfer is accomplished by way of this data bus and associated buffers in an eight bit parallel format and the read/write selection signals from the address decoder insure that at any given time there is never more than one set of bus drivers transmitting data. Preset switches 51 for introducing data relating to fares, or other information, may also be provided, if desired.

Figure 3:
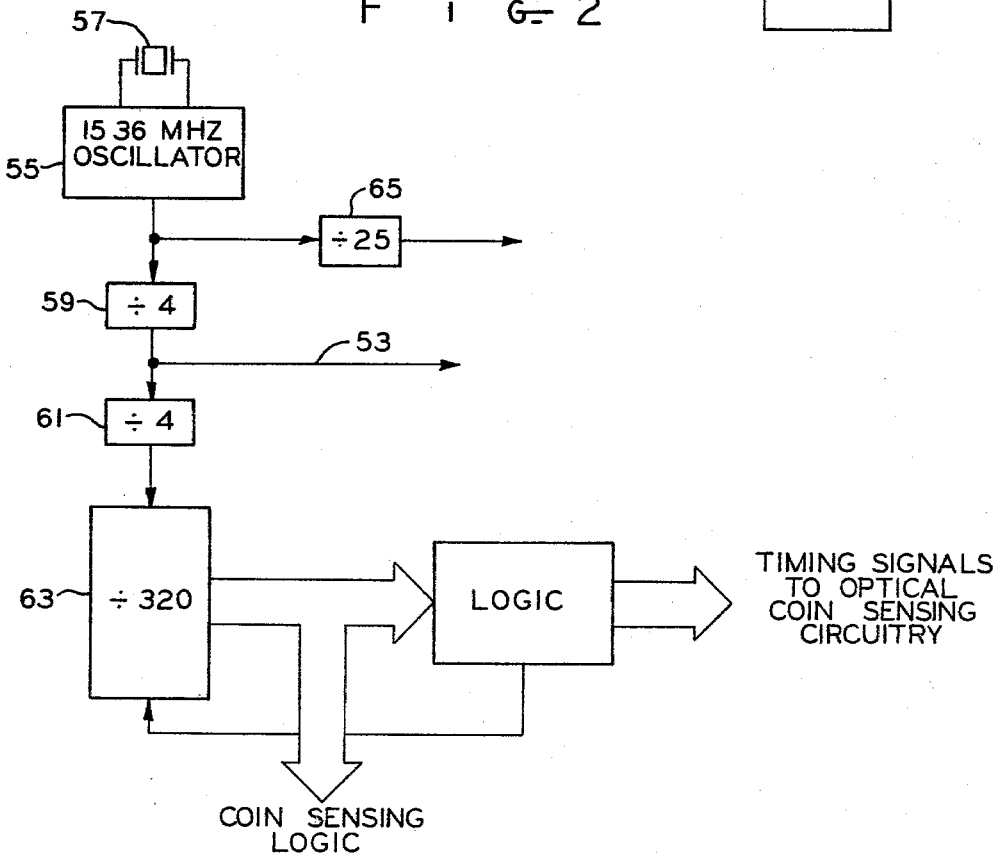
FIG. 3 is a block diagram of a portion of the processor of FIG. 1 illustrating the generation of timing signals in greater detail.

The basic timing generation arrangement for the system is illustrated in FIG. 3 with line 53 providing the input to the clock generator 35 of FIG. 1. That clock generator in turn provides a pair of non-overlapping 960 kilohertz clock signals which provide the internal timing for the microprocessor unit 21. The clock generator circuit 35 may comprise an MC6875 clock generator. An oscillator 55 provides a 15.36 megahertz signal under the control of crystal 57 which signal experiences consecutive divide by four operations in the dividers 59 and 61, followed by a divide by three hundred and twenty operation in the counter 63, which counter provides at its output timing signals to the optical coin sensing circuitry. This counter output is, for example, 29,880 Hertz. Dividers 59 and 61 may comprise a single 74L5163 counter with appropriate outputs for the 3.84 megahertz signal on line 53, as well as the 960 kilohertz output to the counter 63. An optional divide by 25 counter 65 may be employed to provide a 614.4 kilohertz clocking signal to interface the present system with another arrangement for accumulating data from several such systems.

Figure 4:
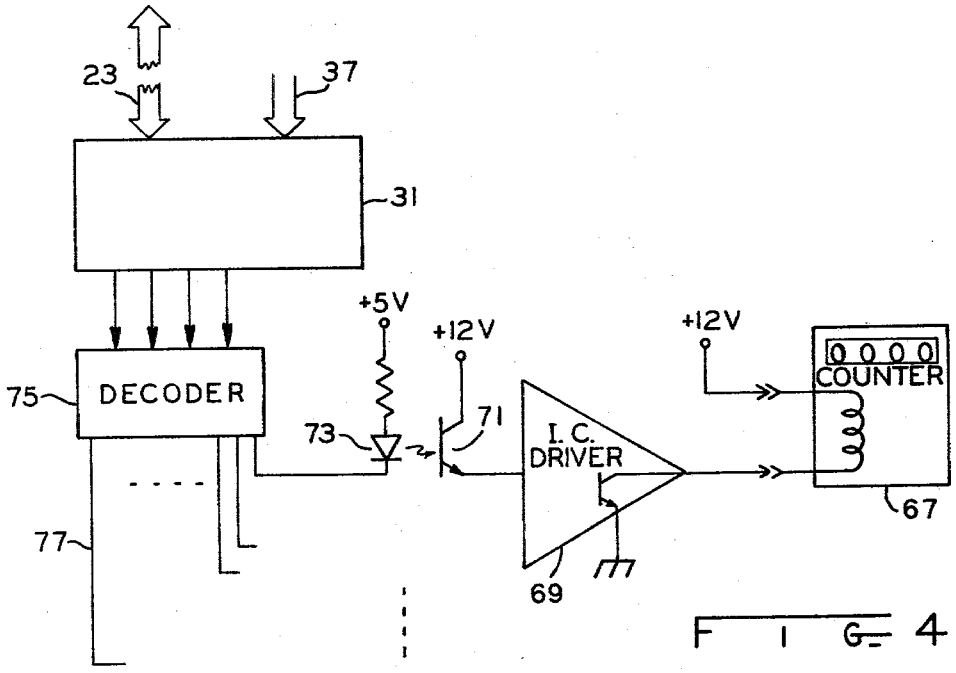
FIG. 4 is a schematic diagram, partially in block form, illustrating the output circuitry for the processor of FIG. 1 for driving an electromechanical counting device.

The registration of various accumulated counts is accomplished by electromechanical counters, such as 67 of FIG. 4. These counters are pulsed by the processor in response to appropriate input for incrementing the counter. Each counter has an associated driver circuit 69 which may, for example, be an integrated circuit of type ULN-2004 or SN75469. Driver circuit 69 receives an input from the emitter of phototransistor 71, the collector of which is coupled to a positive voltage source. Phototransistor 71 is enabled when a corresponding light emitting diode 73 is forward biased and adequately conductive. Decoder 75, for example a 75LS154, converts the four bit output from the interface adapter 31 to a one-out-of-sixteen code on the several output lines, such as 77. Thus, one of these sixteen lines goes active or low in response to each possible four bit input and the light emitting diode associated with that particular low line is energized. When the light emitting diode is energized, it causes the corresponding phototransistor to conduct and turn on the associated driver circuit and counter solenoid. The duration of this "on" pulse, is controlled by the processor, and the solenoid is turned "off" by the processor when an unused code is supplied on the four line input to the decoder 75, causing one of the sixteen output lines which is unused, to go low and the remaining lines to go high, turning off their associated light emitting diodes. Of course, only one light emitting diode may be enabled at any one time and any desired number of diodes, up to sixteen, may be used with one such decoder. Pulse duration depends upon the type of counter employed and may, for example, be in the range of 20 to 80 milliseconds.

If the system for receiving tokens (transit authority tokens, as well as coins of varying denominations) is employed in a fare box, a number of operator actuable pushbutton switches may be employed for providing inputs to the processor. Such input switches might, for example, include a dump switch for releasing a plate supporting the tokens for visual inspection after such inspection, as well as a number of passenger classification switches (student, senior citizen, etc.) and a coin mechanism dejam switch for correcting a coin path blockage as might occur in a singulator mechanism 79 of FIG. 6. A switch input circuit employing optical isolation analogous to that employed in FIG. 4 is illustrated in FIG. 5, wherein the pushbutton 19 completes the series circuit from a positive voltage source by way of current limiting resistor 81 and light emitting diode 83 to ground, thus energizing that light emitting diode. The light emitting diode in turn enables the phototransistor 85 to conduct, providing a "low" input signal on line 87 to the peripheral interface unit 33. The processor program periodically, for example every ten milliseconds, reads the inputs through this peripheral interface unit to see if a switch has been closed. The program is arranged to store consecutive states of the switch inputs for the last two samples to thereby each time a switch input is interrogated, look for a switch to have gone through the sequence OPEN-CLOSED-CLOSED. When this particular sequence occurs, for any switch input, the program interprets this as a genuine switch activation, so that in effect switch bounce, having a duration of less than twenty milliseconds is filtered out by the program arrangement. Separate ground circuits are also employed for complete optical isolation.

In FIG. 6, a light emitting diode 89 and phototransistor 91 straddle the coin path near the coin entrance with the light emitting diode continually enabled and the phototransistor 91 conducting so long as a coin does not break the light path between the diode 89 and phototransistor 91. So long as the phototransistor 91 remains conducting, Darlington pair 93 remains in its non-conducting state, presenting a high or logical zero level to the interface adapter 33. Passage of a coin through the upper portion of the coin chute interrupts the light beam, rendering phototransistor 91 non-conducting and Darlington pair 93 conducting to present a low or active input signal to two input lines of the interface adapter 33. If either of these input lines is active, the program initiates a sequence to turn on a motor driving the singulator 79 to arrange input coins, or other tokens in single file for further processing.

Coins and other tokens serially fall from singulator 79 on down the token chute 95. A light source 11 is disposed to one side of the token chute while an array of light sensing elements 13 is disposed to the side opposite the light source with a relatively transparent region including the transparent plates 15 and 17 forming a part of the token chute intermediate the light source and the array.

In greater detail, the light source may include not only the incandescent light source 11, but also a pair of acrylic Fresnel lenses 97 and 99 in a conventional condenser configuration, along with a pair of filters 101 and 103. Filter 101 may, for example, be an infrared absorbing or blue filter, to minimize unwanted infrared rays within the system, while filter 103 may, for example, be a non-uniform neutral density filter, which attenuates the light intensity in the central portion of the coin path, making the coin path illumination more uniform. This non-uniform neutral density filter 103 may be employed to make the light intensity incident on the several light sensing array elements more nearly the same.

A multi-element imaging lens 103 may also be provided to cast the shadow or silhouette of a coin or other token passing through the transparent region of the token chute onto the linear array of light sensing elements 13. The light sensing array may be one of the several monolithic arrays available from Fairchild which, for example, may have 256 light sensing elements, each with an active area length of about 0.0005 inches, thus providing a sensing length of 0.128 inches in 256 discrete parts. The optical system magnification thus would be selected to be about 0.1 to accommodate all of the conventionally encountered coins and other tokens.

Turning now to FIG. 7, which illustrates the token measurement electronics, the linear light sensing array 13 is interrogated a plurality of times during the passage of a token through the transparent region of the token chute. For example, forty to eighty such interrogations for conventional size tokens may occur. The first light to dark transition within the array has an identifying code associated therewith stored in the eight bit register 107, while the last dark to light transition within the array during a single interrogation is indicated by a code stored in register 109. The difference between the contents of these two registers is then indicative of the length of a chord of the token.

The basic scan period of the sensing array is 333 microseconds, which corresponds to one complete counting cycle of the counter 63 of FIG. 3. During counter states zero through 255, video information corresponding to the light incident on consecutive light sensing cells, during the previous scan period, is serially shifted from a shift register 111 to one input of each of the comparators 113 and 115. Comparator 115, which may for example be an LM311 comparator, provides a high output signal indicating that the light incident on a corresponding light sensing cell during the previous scan period exceeded the threshold as, for example, set by voltage dividing resistor 117, whereas a low output from the comparator 115 indicates that the light incident on the particular cell did not exceed the threshold level and accordingly that cell content is treated as being dark. The high (light) or low (dark) signals are serially supplied to a three bit shift register 119, the three stages of which supply signals to the edge detecting logic circuitry 121 for providing a first light to dark transition signal on line 123 and a last dark to light transition signal on line 125, which signals are used to update the contents of the eight bit registers 107 and 109 so that those registers contain particular states of the counter 63 identifying the sensor cells at which the respective changes from light to dark or dark to light occur. Thus, during each complete cycle of the counter 63, in counting from zero to its maximum count, the edge detector logic 121, provides a signal on line 123 to transfer the particular counter count into the eight bit register 107 upon the first occurrence in shift register 119 of a LIGHT-DARK-DARK or HIGH-LOW-LOW indication during that counter cycle while upon each occurrence during that counter cycle of a DARK-LIGHT or LOW-HIGH-HIGH, a signal is provided on line 125 to transfer the particular counter count from counter 63 to the eight bit register 109, obliterating the prior contents of that register 109.

The linear light sensing array 13 may, for example, be considered to have 256 individual light sensing cells disposed in a linear array 127 on which the light is incident and integrated over a complete cycle of counter 63. Once during each complete cycle of that counter 63, the analog contents of the cells 127 are transferred in parallel to a shift register arrangement 111 and the light sensing and integrating process repeated from a dark or zero condition. During the next counting cycle of counter 63, shift register 111 is shifted out in series and in step with the particular counts of the counter 63 so that the counter state identifies a particular one of the prior light sensing cells at the time that the analog signal representing the light incident on that cell is compared to the threshold value. Thus, the counter state gated into register 107 or 109 indicates the corresponding cell at which the light to dark or dark to light transition occurs. The cyclic rate of counter 63 is sufficiently high that the token is nearly stationary during each such cycle and the difference between the contents of counters 107 and 109 represents a chord length for that particular token.

Also, once during each cycle of counter 63, the contents of registers 107 and 109 are transferred by way of the peripheral interface unit 29 to the processor to perform the actual chord length computation. The processor causes successive acceptable token chord length indications to be stored and after numerous chord length measurements selects the largest acceptable chord length indication for comparison with a set of values stored in the read only memory 25 which identify particular acceptable token diameter ranges and if the largest chord length indication falls within one of these acceptable diameter ranges, the processor provides an indication that the token is of a particular acceptable type. As noted earlier, a chord length indication may be unacceptable if, for example, it differs too much from the immediately preceding indication. In one preferred embodiment the array extended generally perpendicular to the token path.

The sensor video signals which are serially supplied from the shift register 111 to comparator 115 are also supplied to a threshold comparator 113 to provide a bulb intensity feedback arrangement. The bulb intensity regulator circuit 129 includes an eight bit up/down counter and resistor ladder network to form a digital to analog converter which tracks the bulb intensity and provides an input to a UA723 voltage regulator which provides the bulb voltage. The bulb or lamp voltage may be adjusted, for example every 16 scans or complete cycles of counter 63 by counting the up/down counter up or down one state based on the lamp video input.

Figure 8:
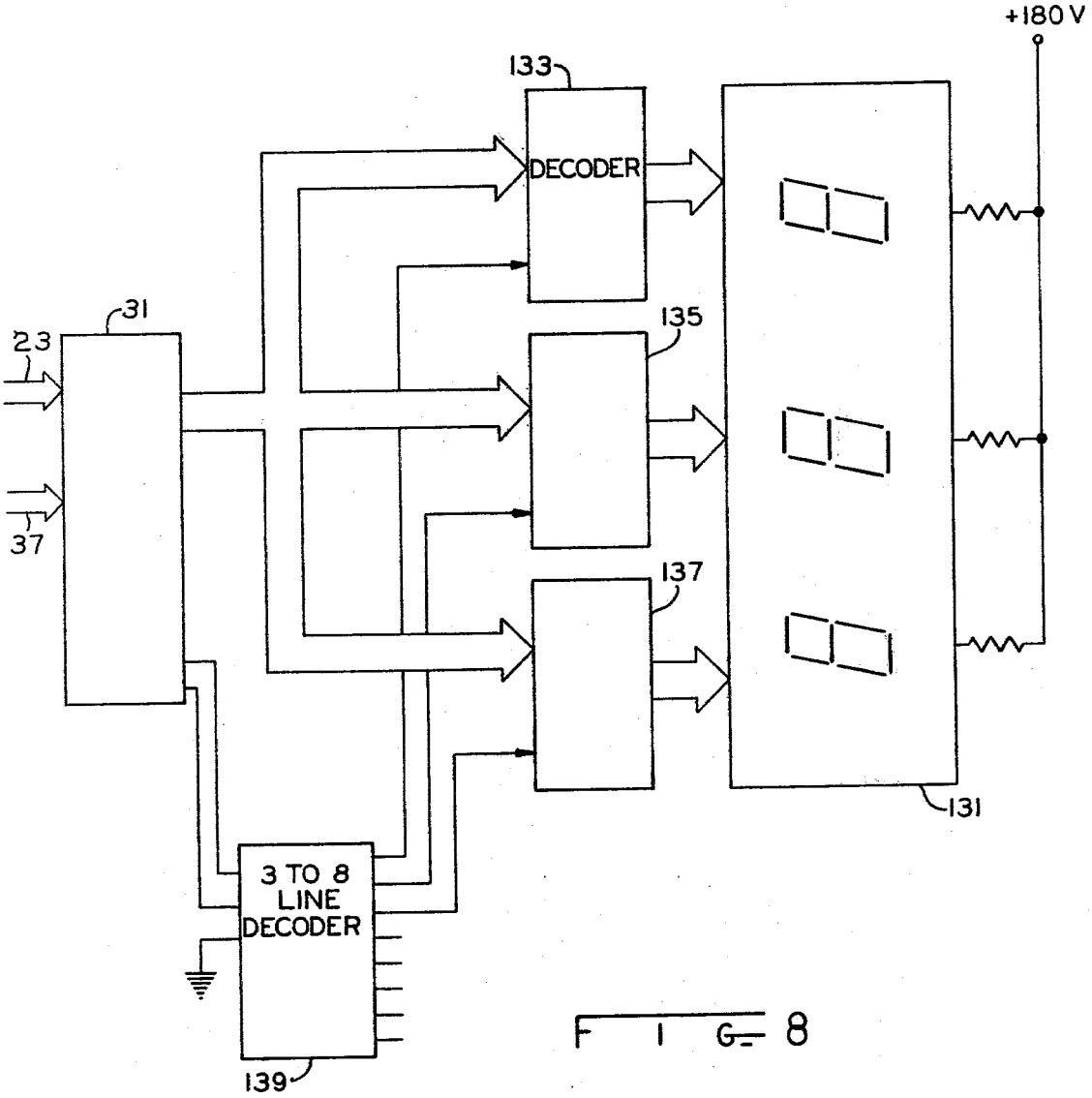
FIG. 8 is a schematic representation of an output data display arrangement for the processor of FIG. 1.

A three digit gas discharge display arrangement 131 which may be employed to display the denomination of successive tokens or the accumulated denominations of several tokens prior to the operator dumping the inspection plate, is illustrated in FIG. 8. The three seven-segment digits of the display arrangement 131 receive respective seven-segment codes from the binary coded decimal to seven-segment decoder drivers 133, 135 and 137. These decoder drivers in turn receive four bit binary coded decimal indications of a particular digit from the interface adapter 31. The several decoder drivers periodically are activated by signals on digit select lines emanating from a line decoder 139. The decoder 139 is actually a three bit to one-out-of-eight decoder, however, only two input bits are active and only three digit select output lines are used in the present display arrangement. With gas discharge display elements some inter-digit blanking time is desirable to allow the gas ionization to decay and a new digit to be displayed. If each digit select line at the output of decoder 139 is enabled for 333 microseconds, the repetition rate for each digit will be 375 Hertz well above the critical flicker frequency, while still providing ample inter-digit blanking time.

Figure 9:
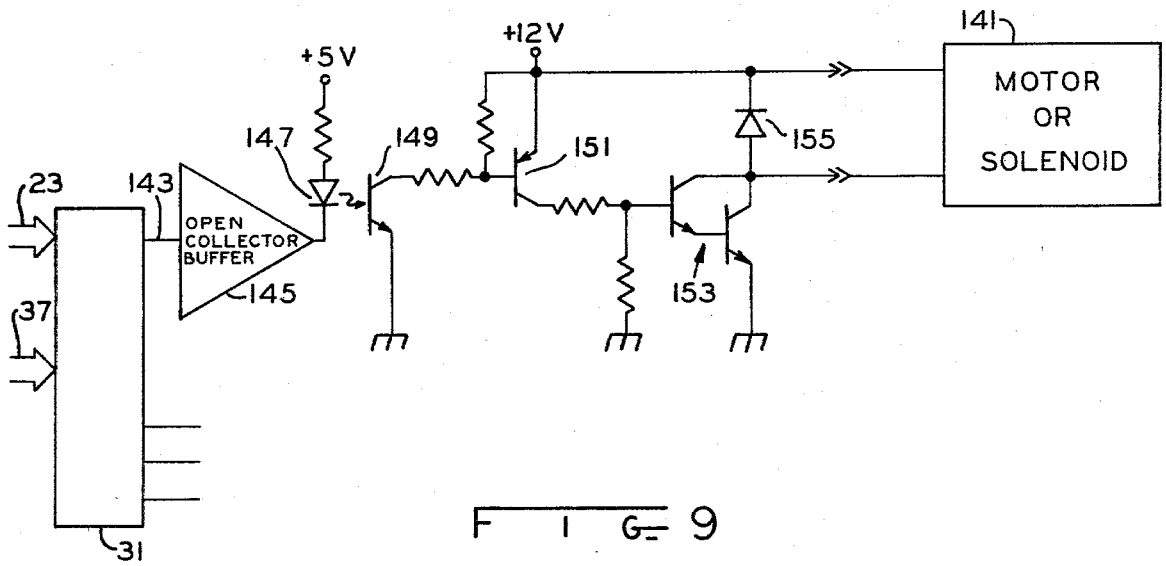
FIG. 9 is a schematic diagram of an arrangement for driving an electromechanical device from the output of the processor of FIG. 1.

A vehicle mounted fare box may contain several motors and large solenoids which may be controlled by the processor and may, for example, include a drive motor for the singulating device, a paper transport motor, a solenoid for dumping the inspection plate, and a further solenoid for eliminating token jams within the singulator 79, as well as other electromechanical devices, as desired. In FIG. 9, block 141 illustrates such a motor or solenoid under pressure control by way of the interface adapter 31. When one of the several interface adapter output lines, such as 143, goes to a low logic level, the open collector buffer 145 allows current flow through the light emitting diode 147, enabling photo-transistor 149 to conduct. The light emitting diode and photo-transistor comprise an optical isolator of the type discussed earlier. Conduction by the phototransistor 149 turns on a predrive transistor 151 as well as the Darlington pair or high current drive transistor 153 to enable the motor or solenoid 141. A snubber diode 155 for dissipating the transient currents which may occur when a highly inductive load is abruptly turned off may also be included along with the appropriate current limiting resistors. The motor or solenoid 141 is, of course, turned off when line 143 goes back to its high state.

Figure 10:
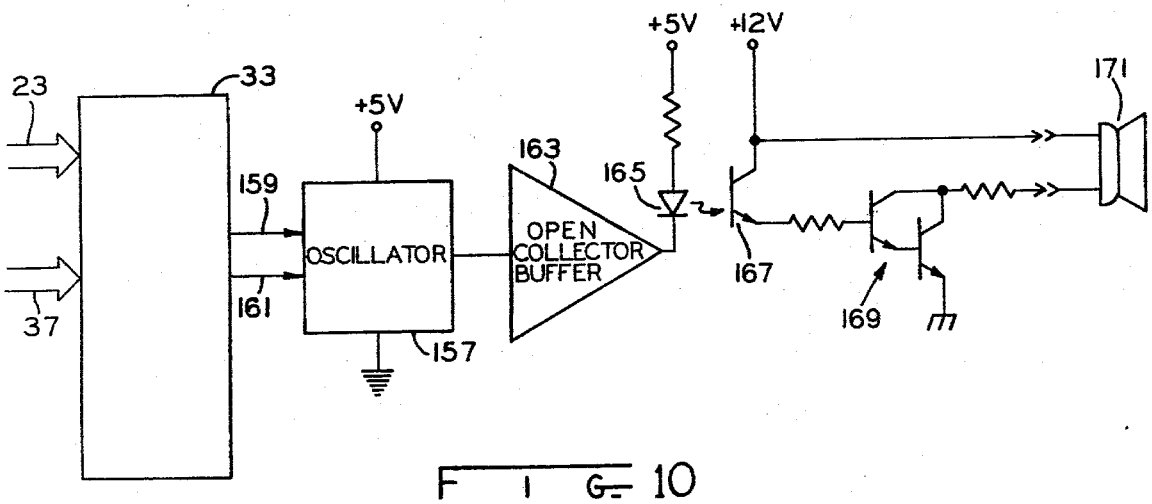
FIG. 10 illustrates the driving of a further electromechanical device such as an audio output from the processor of FIG. 1.

In a mobile fare box it may be desired to provide one or more audio signals indicative, for example, of the depositing of an unacceptable token, or the accumulation of a sufficient number of tokens to provide the required fare. These or other monetary or manual inputs may provide one or more output tone signals by way of the tone generator circuitry illustrated in FIG. 10. A dual frequency oscillator 157 remains off so long as both of its inputs on lines 159 and 161 remain in their high logic state. Processor control lowers, by way of the interface adaptor 33, one of these lines to create a given tone signal. The low level on an input line to the oscillator 157 enables that oscillator to provide an output by way of the open collector buffer 163 to a further optical isolating arrangement including the light emitting diode 165 and photo-transistor 167. An oscillator signal provides an audio fluctuation in the light from the light emitting diode similarly enabling a fluctuating current flow in the photo-transistor 167 which by way of the high current Darlington pair 169 provides an audio input to the speaker 171.

From the foregoing it is now apparent that a novel vehicular fare system for receiving tokens and a novel method of categorizing tokens as particular ones of several acceptable tokens or as an unacceptable token as well as a fare collection system employing a microprocessor and uniquely suited for mounting in a mobile system such as a public transit bus have been disclosed meeting the objects and advantageous features set out hereinbefore as well as others and that modifications as to the precise configurations, shapes and details as well as the precise steps of the method may be made by those having ordinary skill in the art without departing from the spirit of the invention or the scope thereof, as set out by the claims which follow.

What is claimed is:

1. A system for receiving tokens comprising:
a token chute;
a light source disposed on one side of the token chute;
an array of light sensing elements disposed to the side of the token chute opposite the light source;
a relatively transparent region in the token chute intermediate the light source and the array;
means for interrogating the array a plurality of times during the passage of a token through the transparent region including register means for receiving and storing an analog indication of the light incident on a corresponding light sensing element, means for comparing the stored analog indication to a reference analog indication and for providing a first digital indication when the stored analog indication is less than the reference analog indication and a second digital indication when the stored analog indication exceeds the reference analog indication, a counter repetitively sequentially incrementable during each cycle thereof between minimum and maximum counts, means operable once during each counter cycle for updating all of the register means analog indications and for resetting the light sensing elements to an initial condition, and means operable upon sequential counter incrementations to supply the analog indication from the register means serially to the means for comparing;

means for identifying light to dark and dark to light transitions within the array during each interrogation thereof including first and second registers, means for transferring the contents of the counter to the first register upon the first occurrence of the first digital indication during each counter cycle, means for transferring the contents of the counter to the second register upon each occurrence of a first digital indication followed directly by a second digital indication, successive transfers obliterating the prior contents of the second register;

means responsive to the identifying means for providing an indication of the length of a chord of the token; and processing means for storing successive token chord length indications, selecting the indication of the largest chord length, comparing that largest chord length indication with each of a plurality of different acceptable token indications, and identifying the token as a particular acceptable type if the indication of the largest chord length matches the corresponding particular acceptable token indicator.

2. The token receiving system of claim 1 wherein the array of light sensing elements comprises a linear array disposed generally perpendicular to and displaced from the path of a token through the chute.

3. The token receiving system of claim 1 wherein the array is repetitively interrogated at a rate sufficiently fast to provide about 40 to 80 chord length indications during passage of a token, the number of indications depending on the token size and velocity.

4. The token receiving system of claim 1 wherein the chord length indication means includes means for subtracting the contents of the first register from the contents of the second register once during each counter cycle.

5. The token receiving system of claim 1 further comprising operator actuable switch means for supplying information to the processing means including first and second electrically isolated circuits, the first circuit including a switch and a light emitting diode in series with a voltage source, closure of the switch energizing the light emitting diode, the second circuit including a photo transistor which when rendered conductive supplies an electrical input to the processing means.

6. The token receiving system of claim 1 further comprising electromechanical output means for utilizing processing means token identifications, and optical isolation means coupling the processing means to the electromechanical output means.

7. The token receiving system of claim 6 wherein the optical isolation means includes a light emitting diode and a photo transistor juxtoposed so that the photo transistor may conduct only when the light emitting diode is energized.

8. The token receiving system of claim 1 wherein the token chute includes means for arranging tokens in single file to sequentially drop past the light source.

9. The token receiving system of claim 8 wherein the token chute further includes means responsive to token passage for enabling the means for arranging.

10. The method of categorizing a token as a particular one of several acceptable tokens or as an unacceptable token comprising the steps of:

performing a series of measurements of chord lengths on the token;

selecting the largest chord length measurement;

comparing the largest chord length measurement with each of a plurality of stored disjoint token diameter ranges;

recording an indication of a particular acceptable token denomination only if the largest chord length measurement is within a stored token diameter range corresponding to that denomination; and comparing successive chord length measurements and categorizing a measurement as unacceptable if two successive chord length measurements differ by more than a predetermined amount.

11. The method of claim 10 including the further steps of accumulating a total of the number of certain token denominations received and accumulating a total of the monetary value corresponding to certain other received token denominations.

12. The method of claim 10 wherein each stored token diameter range includes a first stored value indicating a minimum acceptable chord length measurement and a second stored value indicating a maximum acceptable chord length measurement.

13. The method of claim 10 wherein each stored token diameter range includes a nominal chord length measurement and acceptable tolerance ranges therefor.

14. The method of claim 10 wherein the series of measurements are performed by causing the token to fall between a light source and a linear light sensing array, the light source casting a shadow of the token onto the array, each measurement including the steps of identifying the first location within the array at which a transition from light to shadow occurs and identifying the last location within the array at which a transition from shadow to light occurs.

15. The method of claim 14 including the further steps of periodically sensing the intensity of the light source, comparing the sensed intensity to a reference, dimming the light source if the sensed intensity exceeds the reference, and increasing the intensity of the light source if the reference exceeds the sensed intensity.

16. The method of claim 10 including the further step of temporarily displaying visible indications of received acceptable token denominations.

17. The method of claim 16 including the further step of visually inspecting a token after that token has been measured and the denomination thereof displayed as a cross check to insure that the displayed denomination is correct.

18. The method of categorizing a token as a particular one of several acceptable tokens or as an unacceptable token comprising the steps of:

performing a series of measurements of chord lengths on the token;

selecting the largest chord length measurement;

comparing the largest chord length measurement with each of a plurality of stored disjoint token diameter ranges;

recording an indication of a particular acceptable token denomination only if the largest chord length measurement is within a stored token diameter range corresponding to that denomination; and periodically interrogating input switch means and recognizing a change in switch state only if three successive interrogations thereof show the switch to first be in one state and thereafter on the second and third interrogations to be in another state.

19. The method of claim 18 including the further steps of defining a monetary amount by manipulating the input switch means, accumulating a total of the monetary value corresponding to certain received token denominations, and providing an indication when the accumulated total becomes at least as large as the defined amount.

* * * * *

UNITED STATES PATENT AND TRADEMARK OFFICE

CERTIFICATE OF CORRECTION

PATENT NO. : 4,249,648

DATED : February 10, 1981

INVENTOR(S) : John A. Meyer

It is certified that error appears in the above-identified patent and that said Letters Patent are hereby corrected as shown below:

Col. 8, line 43, "dark-light" should be -- dark-light-light --

Col. 9, line 64, "pressure" should be -- processor --

IN THE CLAIMS

Claim 1, Col. 10, Line 52, "on" should be -- to --

Claim 4, Col. 11, Line 43, "indication" should be -- indicating --

Signed and Sealed this

*Twenty-eighth* Day of *April 1981*

[SEAL]

*Attest:*

RENE D. TEGTMEYER

*Attesting Officer*

*Acting Commissioner of Patents and Trademarks*